United States Patent [19]

Matsumoto

[11] Patent Number: 4,487,513

[45] Date of Patent: Dec. 11, 1984

[54] WATCH CASE STRUCTURE

[75] Inventor: Masataka Matsumoto, Tokorozawa, Japan

[73] Assignee: Citizen Watch Co., Ltd., Tokyo, Japan

[21] Appl. No.: 460,603

[22] Filed: Jan. 24, 1983

[30] Foreign Application Priority Data

Jan. 27, 1982 [JP] Japan ..... 57-11345

[51] Int. Cl.[3] ..... G04B 37/00

[52] U.S. Cl. ..... 368/294; 368/276; 368/281; 368/296

[58] Field of Search ..... 368/10, 294–296, 368/309, 276, 280–283, 285

[56] References Cited

U.S. PATENT DOCUMENTS 4,072,004 2/1978 Tanaka et al. ..... 368/10

4,201,043 5/1980 Tarusawa ..... 368/10

*Primary Examiner*—Bernard Roskoski

*Attorney, Agent, or Firm*—Koda and Androlia

[57] ABSTRACT

A watch case structure including a plate member fixed on the inner periphery of the upper part of a caseband and provided with an opening; a bezel fixed along the rim of the opening in the plate member; and an upper glass fixed on the inner periphery of the upper part of said bezel. The plate member can be made from metal or glass and if made from glass, part of the display can be provided thereunder.

9 Claims, 5 Drawing Figures

WATCH CASE STRUCTURE

BACKGROUND OF THE INVENTION

1. Field of the Invention

This invention relates to a watch case structure, and more particularly to a watch structure with a thinner appearance and more design variation.

2. Prior Art

FIG. 1 is a partially sectional view of a standard type of watch case conventionally used, including three parts: a glass 1, a caseband 2, and a back 3, in which the caseband 2 is closed at its upper part by the glass 1 and at its lower part by the back 3. In this type of watch, the thickness, t, of the caseband 2 is looked on as the thickness of the watch case.

FIG. 2 is also a partially sectional view of another standard type of watch case conventionally used, including four parts: a glass 4, a bezel 5, a caseband 6, and a back 7, in which the bezel 5 and the caseband 6 are combined with a step, the bezel 5 is closed at its upper part by the glass 4, and the caseband 6 is closed at its lower part by the back 7. In this type of watch, the bezel 5 looks like the rim of the glass 4. Therefore, the thickness, t', of the caseband 6 is looked on as the thickness of the watch case. In appearance this case looks thinner than the watch case of FIG. 1 by t-t'. That is to say, a watch case of the type in which a separate bezel and caseband are combined with a step has an effect of looking thinner in appearance than the other types of watch cases when they have the same thickness.

Especially, a watch whose design is emphasized often employs the latter complicated structure rather than the former simple structure so that the watch not only looks as thin as possible but also shows some design with the different finishes of the bezel and the caseband.

SUMMARY OF THE INVENTION

This invention originated from the technique of thin appearance mentioned above. The object of the invention is to provide a new structure of a watch case which looks thinner than before and to provide a unique design by means of the development of the structure shown in FIG. 2.

According to the subject matter of the invention there is provided a watch case structure including a plate member fixed on the inner periphery of the upper part of the caseband and provided with an opening; a bezel fixed in the inner periphery of the opening of the plate member; and a watch glass fixed on the inner periphery of the upper part of the bezel.

DESCRIPTION OF THE PREFERRED EMBODIMENTS

The embodiments of the invention will now be described in detail with reference to the drawings.

Figure 3:
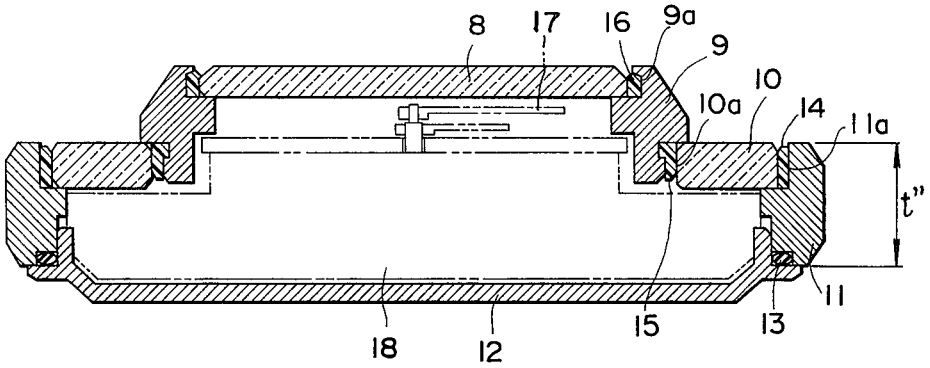
FIG. 3 is a sectional view of a watch case illustrating an embodiment of the present invention.

FIG. 3 is a sectional view of a watch case illustrating a first embodiment of the invention, comprising five parts; an upper glass 8, a bezel 9, a lower glass 10, a caseband 11, and a back 12. The caseband 11 is closed at its lower part by the back 12 and sealed by means of an O ring 13 for water resistance. The lower glass 10 compresses the inner periphery of a packing 14 lodged on a shoulder 11*a* of the inner periphery of the upper part of the caseband 11. The lower glass 10 is provided with an opening 10*a* to form a ring. To the lower glass 10, the bezel 9 is fixed by pressing the outer periphery of a packing 15 lodged on the outer periphery of the lower portion of the bezel 9 into the opening 10*a*.

In addition, the upper glass 8 is pressed onto the inner periphery of a packing 16 lodged in a groove 9*a* of the inner periphery of the upper part of the bezel 9. A part of a watch mechanism 18 having a display area 17 occupies a space enclosed with the upper glass 8 and the bezel 9.

To assemble the structure of the present invention, the upper glass 8 is first fixed onto the bezel 9 through the packing 16 and the bezel 9 is secured into the lower glass 10 through the packing 15. Then the lower glass 10 is fixed onto the caseband 11 through the packing 14.

Figure 1:
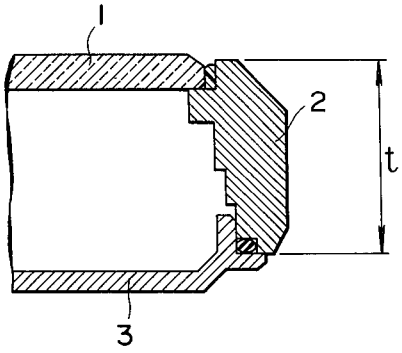
FIG.1 PRIOR ART
FIG. 1 is a partially sectional view of a standard type of watch case conventionally used.
Figure 2:
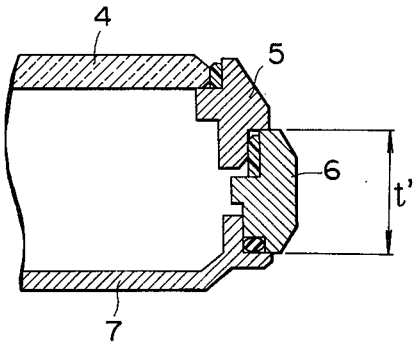
FIG.2 PRIOR ART
FIG. 2 is a partially sectional view of another standard type of watch case conventionally used.

The structure of the present invention described above permits the upper glass 8 and the lower glass 10 to be combined with a step through the bezel 9. The upper glass portion looks convex, which in turn causes the caseband 11 to look concave. Therefore, although the thickness, t'', of the caseband 11 of the present invention is actually the same as the thickness, t', of the caseband 6 of FIG. 2, the caseband 11 looks thinner than the caseband 6.

Figure 4:
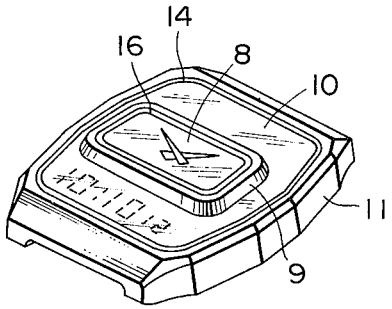
FIG. 4 is a perspective view of the embodiment of FIG. 3.

Furthermore, utilizing the effect of design that the bezel 9 divides the display area into the upper glass 8 and the lower glass 10, for example, as shown in the perspective view of FIG. 4. Part of the upper glass 8 is used as an analog display and part of the lower glass 10 is used as a digital display for a dual time mode. The structure of the present invention thus has effects of giving a unique display and a variety of watch designs.

Figure 5:
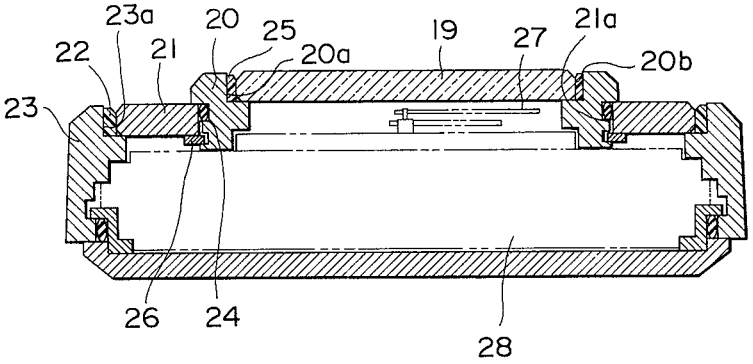
FIG. 5 is a sectional view of a watch case illustrating another embodiment of the present invention.

FIG. 5 is a sectional view of a watch case illustrating a second embodiment of the invention. A metal plate 21 compresses the inner periphery of a packing 22 lodged on a shoulder 23*a* of the inner periphery of the upper part of the caseband 23. The metal plate 21 is provided with an opening 21*a* in its middle part to form a ring.

A packing 24 is lodged in a groove 20*b* of the outer periphery of the vertical middle part of the bezel 20, and the outer periphery of the packing 24 is pressed into the opening 21*a*, and then the bezel 20 is set in the metal plate 21 with a retaining ring 26 inserted to prevent the bezel 20 from coming off the metal plate 21.

In addition, a packing 25 is positioned on the shoulder 20*a* of the inner periphery of the upper portion of the bezel 20. A watch glass 19 is pressed onto the inner periphery of the packing 25. A watch mechanism 28 having a display area 27 occupies a space enclosed with the watch glass 19 and the bezel 20. In this embodiment, the lower glass of the first embodiment is replaced by the metal plate. This second embodiment shows as thin an appearance as the first embodiment, and simultaneously it is capable of producing the desired shape, surface pattern and color and provides a firm structure. Although not shown, the metal plate 21 can be provided with holes such as a pushbutton mounting hole and a sound emitting hole for use in the multifunctional and advantageous form.

I claim:

1. A watch case structure comprising:

a caseband made quite thin with respect to a total thickness of the watch;

a flat plate member fixed on the inner periphery of the upper part of said caseband and provided with an opening, said flat plate member occupying a great part of the total top area of the watch;

a bezel fixed in the inner periphery of the opening of said flat plate member; and a watch galss fixed on the inner periphery of the upper part of said bezel.

2. A watch case structure according to claim 1 wherein said flat plate member is made of glass.

3. A watch case structure according to claim 1 wherein said flat plate member is made of metal.

4. A watch case structure according to claim 1 wherein said flat plate member is fixed on the inner periphery of said caseband through a first packing; said bezel is fixed in the opening of said plate member through a second packing; and said watch glass is fixed on the inner periphery of said bezel through a third packing.

5. A watch case structure according to claim 1 wherein said opening is provided in the substantially middle part of said flat plate member.

6. A watch case structure according to claim 1 wherein a part of a watch mechanism having a display occupies a space enclosed with said bezel and said watch glass.

7. A watch case structure according to claim 6 wherein said display is an analog display.

8. A watch case structure comprising:

a caseband made quite thin with respect to a total thickness of the watch;

a lower flat glass fixed on the inner periphery of the upper part of said caseband through a first packing and provided with an opening in the substantially middle part thereof, said lower flat glass occupying a great part of a total top area of the watch;

a bezel fixed in the inner periphery of the opening of said lower flat glass through a second packing; and an upper flat glass fixed on the inner periphery of the upper part of said bezel through a third packing;

wherein a part of a watch mechanism having an analog display occupies a space enclosed with said upper flat glass and said bezel; and a digital display occupies a space under said lower flat glass.

9. A watch case structure comprising:

a caseband made quite thin with respect to a total thickness of the watch;

a flat metal plate fixed on the inner periphery of the upper part of said caseband through a first packing and provided with an opening in the substantially middle part thereof, said flat metal plate occupying a great part of a total top area of the watch;

a bezel fixed in the inner periphery of the opening of said flat metal plate through a second packing; and a flat glass fixed on the inner periphery of the upper part of said bezel through a third packing;

wherein a part of a watch mechanism having an analog display occupies a space enclosed with said bezel and said flat glass.

* * * * *